US009724800B2

(12) United States Patent
Han et al.

(10) Patent No.: US 9,724,800 B2
(45) Date of Patent: Aug. 8, 2017

(54) WAFER POLISHING APPARATUS

(71) Applicant: LG SILTRON INCORPORATED, Gumi-si, Gyeongsangbuk-do (KR)

(72) Inventors: Kee Yun Han, Gumi-si (KR); Eun Suck Choi, Gumi-si (KR)

(73) Assignee: LG Siltron Incorporated, Gumi-Si, Gyeongsangbuk-do (KR)

( * ) Notice: Subject to any disclaimer, the term of this patent is extended or adjusted under 35 U.S.C. 154(b) by 0 days.

(21) Appl. No.: 14/753,367

(22) Filed: Jun. 29, 2015

(65) Prior Publication Data

US 2016/0031062 A1 Feb. 4, 2016

(30) Foreign Application Priority Data

Jul. 30, 2014 (KR) ..... 10-2014-0097189

(51) Int. Cl.

| | |
|---|---|
| ***B24B 37/08*** | (2012.01) |
| ***B24B 49/10*** | (2006.01) |
| ***B24B 37/26*** | (2012.01) |
| ***B24B 7/22*** | (2006.01) |

(52) U.S. Cl.

CPC ..... *B24B 49/10* (2013.01); *B24B 7/228* (2013.01); *B24B 37/08* (2013.01); *B24B 37/26* (2013.01)

(58) Field of Classification Search

CPC ..... B24B 37/08; B24B 37/26; B24B 37/34
See application file for complete search history.

(56) References Cited

U.S. PATENT DOCUMENTS

| | | | | |
|---|---|---|---|---|
| 3,888,053 A | | 6/1975 | White et al. | |
| 5,441,442 A | * | 8/1995 | Haisma | B24B 37/12 451/288 |
| 6,652,358 B1 | * | 11/2003 | Ikeda | B24B 7/17 451/262 |
| 8,113,913 B2 | * | 2/2012 | Pietsch | B24B 37/08 451/10 |
| 8,197,300 B2 | * | 6/2012 | Junge | B24B 37/08 451/268 |
| 2010/0221987 A1 | * | 9/2010 | Nagashima | B24B 37/08 451/262 |
| 2015/0380255 A1 | * | 12/2015 | Lee | B24B 37/08 451/262 |

FOREIGN PATENT DOCUMENTS

| | | |
|---|---|---|
| JP | 2004-314192 A | 11/2004 |
| JP | 2008-229828 A | 10/2008 |
| KR | 10-2010-0069788 | 6/2010 |
| SU | 1296382 | 3/1987 |

OTHER PUBLICATIONS

Korean Office Action dated Oct. 8, 2015 issued in Application No. 10-2014-0097189.
Chinese Office Action dated Mar. 13, 2017 issued in Application No. 201510455939.1 (English translation attached).

* cited by examiner

*Primary Examiner* — Timothy V Eley
(74) *Attorney, Agent, or Firm* — KED & Associates LLP

(57) ABSTRACT

Disclosed is a wafer polishing apparatus including a base, a lower surface plate disposed on the upper surface of the base, an upper surface plate disposed on the lower surface plate and a first shape adjustment unit configured to deform the shape of the lower surface of the upper surface plate so that the lower surface of the upper surface plate has one of a concave shape, a flat shape and a convex shape in a first direction, and the first direction is a direction from the lower surface plate to the upper surface plate.

18 Claims, 17 Drawing Sheets

WAFER POLISHING APPARATUS

CROSS-REFERENCE TO RELATED APPLICATION

This application claims the benefit of Korean Patent Application No. 10-2014-0097189, filed on Jul. 30, 2014, which is hereby incorporated by reference as if fully set forth herein.

BACKGROUND OF THE INVENTION

Field of the Invention

The present invention relates to a wafer polishing apparatus.

Discussion of the Related Art

In a double side polishing (DSP) process, a wafer may be polished through friction between pads and the wafer using a slurry as an abrasive by pressing surface plates and flatness of the wafer may be determined.

The DSP process may be executed by chemical-mechanical polishing through a chemical process using chemical action between a slurry and the surface of a wafer and a mechanical process using friction between pads and the wafer by pressing surface plates.

In general, the shape of an upper surface plate and a lower surface plate of a polishing apparatus may be processed in advance prior to a polishing process according to the size of a wafer and an application method.

FIGS. 23A to 23C illustrate upper surface plates and lower surface plates having various shapes.

FIG. 23A illustrates an upper surface plate 11 having a lower surface, the central part of which is concave, and a lower surface plate 12 having an upper surface, the central part of which is convex, FIG. 23B illustrates an upper surface plate 11*a* having a lower surface, the central part of which is convex, and a lower surface plate 12*a* having an upper surface, the central part of which is concave, and FIG. 23C illustrates an upper surface plate 11*b* having a lower surface, the central part of which is convex, and a lower surface plate 12*b* having an upper surface, the central part of which is convex.

If an upper surface plate and a lower surface plate are used at a high pressure for a long time, the shapes of the initially processed upper and lower surface plates may be modified and, thus, re-processing of the shapes of the upper surface plate and the lower surface plate may be required. In order to change the shapes of the upper surface plate and the lower surface plate, the upper surface plate and the lower surface plate are detached from the polishing apparatus and then the detached upper and lower surface plates are re-processed to have desired shapes. In order to change the shapes of the upper surface plate and the lower surface plate, operation of the polishing apparatus needs to be stopped for a long time, thus causing economic loss.

SUMMARY OF THE INVENTION

Accordingly, the present invention is directed to a wafer polishing apparatus that substantially obviates one or more problems due to limitations and disadvantages of the related art.

An object of the present invention is to provide a wafer polishing apparatus which may automatically adjust the shapes of an upper surface plate and a lower surface plate most proper to wafer processing conditions, improve flatness of a wafer, shorten a polishing time, and prevent increase in cost.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a wafer polishing apparatus includes a base, a lower surface plate disposed on the upper surface of the base, an upper surface plate disposed on the lower surface plate, and a first shape adjustment unit configured to deform the shape of the lower surface of the upper surface plate so that the lower surface of the upper surface plate has one of a concave shape, a flat shape and a convex shape in a first direction, wherein the first direction is a direction from the lower surface plate to the upper surface plate.

The first shape adjustment unit may include an upper surface plate supporter configured to support the upper surface of the upper surface plate and including a groove having width increasing in the first direction and a first wedge member inserted into the first groove, the shape of the lower surface of the upper surface plate may be deformed according to the insertion depth of the first wedge member, and the insertion depth of the first wedge member may be a distance between the lower end of the first wedge member inserted into the first groove and the bottom of the first groove.

The first shape adjustment unit may include a plate configured to support the upper surface of the upper surface plate, a support part provided with one end connected to the plate and including a groove having width increasing in the first direction, a first wedge member inserted into the first groove, and a first moving part configured to move the first wedge member in the first direction or a direction opposite to the first direction within the first groove.

The first groove may include a first side surface, a second side surface and a bottom located between the first side surface and the second side surface, and the second side surface may be closer to the outer circumferential surface of the upper surface plate than the first side surface.

An angle formed by the first side surface and a first reference surface may differ from an angle formed by the second side surface and the first reference surface, and the first reference surface may be vertical to the lower surface of the upper surface plate.

The first wedge member may have a cylindrical shape and the first groove may have a cylindrical shape coinciding with the shape of the first wedge member.

A plurality of first grooves may be provided so as to be separated from one another, the first wedge member may includes a ring-shaped connector connected to the first moving part and a plurality of legs connected to the connector, and each of the legs may have a wedge shape and be inserted into the corresponding one of the first grooves.

Prior to insertion of the first wedge member into the first grove, the central part of the lower surface of the upper surface plate may have a concave shape in the first direction or a convex shape in the first direction.

In another aspect of the present invention, a wafer polishing apparatus includes a base, a lower surface plate disposed on the upper surface of the base, an upper surface plate disposed on the lower surface plate, and a second shape adjustment unit disposed between the base and the lower surface plate and configured to deform the shape of the upper surface of the lower surface plate so that the upper surface of the lower surface plate has one of a concave shape, a flat shape and a convex shape in a first direction, wherein the first direction is a direction from the lower surface plate to the upper surface plate.

The second shape adjustment unit may include at least one second wedge member disposed between the upper surface of the base and the lower surface plate and at least one second moving part configured to move the at least one second wedge member in a second direction or the direction opposite to the second direction, the shape of the upper surface of the lower surface plate may be deformed according to the moving position of the at least one second wedge member and the second direction may be a direction from the center of the lower surface plate to the outer circumferential surface of the lower surface plate.

The at least one second wedge member may be disposed closer to the outer circumferential surface of the base than the inner circumferential surface of the base.

A second groove may be provided on the upper surface of the base so that the at least one second wedge member is inserted into the second groove.

The bottom of the second groove may be inclined upwards in the second direction and one end of the bottom of the second groove may have a height difference with the upper surface of the base.

The wafer polishing apparatus may further include a bearing disposed between the second groove and the at least one second wedge member.

A plurality of second wedge members may be provided so as to be disposed symmetrically with respect to the center of the lower surface plate as the origin.

The upper surface of the base may be inclined downwards in the second direction and the second shape adjustment unit may be configured to change the heights of one end and the other end of the upper surface of the lower surface plate.

The second shape adjustment unit may include a support part configured to support a first region of the lower surface of the lower surface plate and an elevating part configured to raise or lower the support part, and the first region of the lower surface of the lower surface plate may be closer to the outer circumferential surface of the lower surface plate than the inner circumferential surface of the lower surface plate.

In a further aspect of the present invention, a wafer polishing apparatus includes a base, a lower surface plate disposed on the upper surface of the base, an upper surface plate disposed on the lower surface plate, a first shape adjustment unit configured to deform the shape of the lower surface of the upper surface plate so that the lower surface of the upper surface plate has one of a concave shape, a flat shape and a convex shape in a first direction, and a second shape adjustment unit disposed between the base and the lower surface plate and configured to deform the shape of the upper surface of the lower surface plate so that the upper surface of the lower surface plate has one of a concave shape, a flat shape and a convex shape in a first direction, wherein the first direction is a direction from the lower surface plate to the upper surface plate.

The first shape adjustment unit may include a plate configured to support the upper surface of the upper surface plate, a support part provided with one end connected to the plate and including a groove having width increasing in the first direction, a first wedge member inserted into the first groove, and a first moving part configured to move the first wedge member in the first direction or a direction opposite to the first direction within the first groove.

The second shape adjustment unit may include at least one second wedge member disposed between the upper surface of the base and the lower surface plate and at least one second moving part configured to move the at least one second wedge member in a second direction or the direction opposite to the second direction, the shape of the upper surface of the lower surface plate may be deformed according to the moving position of the at least one second wedge member and the second direction may be a direction from the center of the lower surface plate to the outer circumferential surface of the lower surface plate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
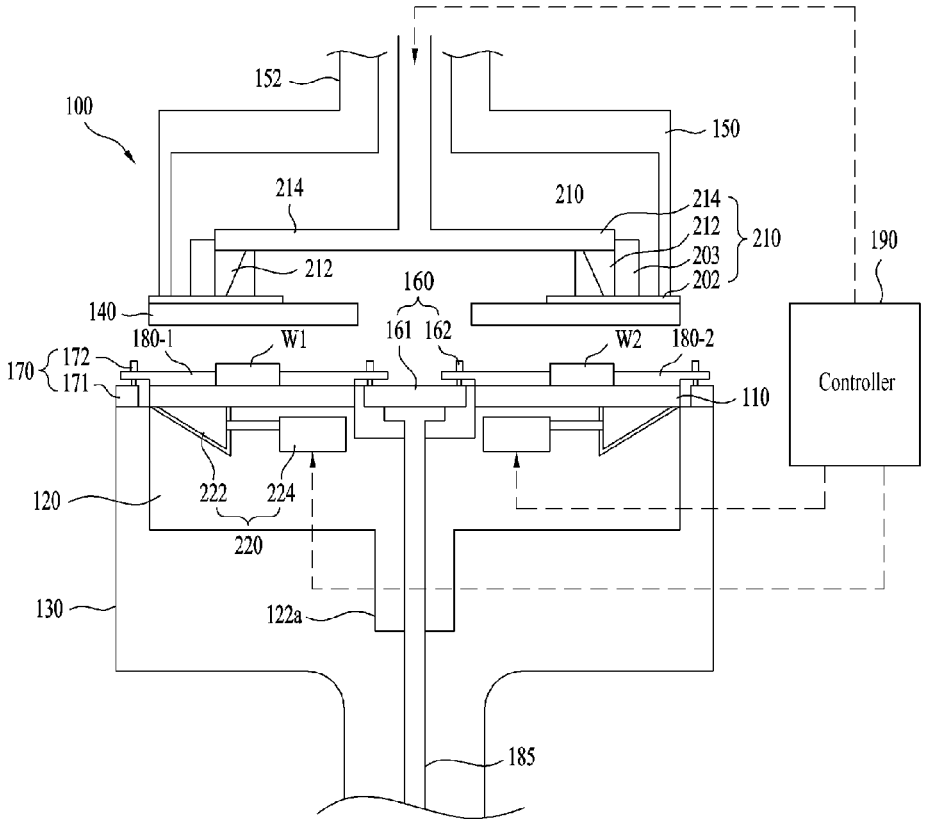
FIG. 1 is a cross-sectional view of a wafer polishing apparatus in accordance with one embodiment.

Reference will now be made in detail to the preferred embodiments of the present invention, examples of which are illustrated in the accompanying drawings. It will be understood that when an element, such as a layer (film), a region, a pattern or a structure, is referred to as being "on" or "under" another element, such as a layer (film), a region, a pad or a pattern, the term "on" or "under" means that the element is directly on or under the other element or intervening elements may also be present. It will also be understood that "on" or "under" is determined based on the drawings.

In the drawings, the sizes of elements may be exaggerated, reduced, or omitted for convenience and clarify of description. Further, the sizes of elements do not mean the actual sizes of the elements. Wherever possible, the same reference numbers will be used throughout the drawings to refer to the same or like parts.

Figure 2:
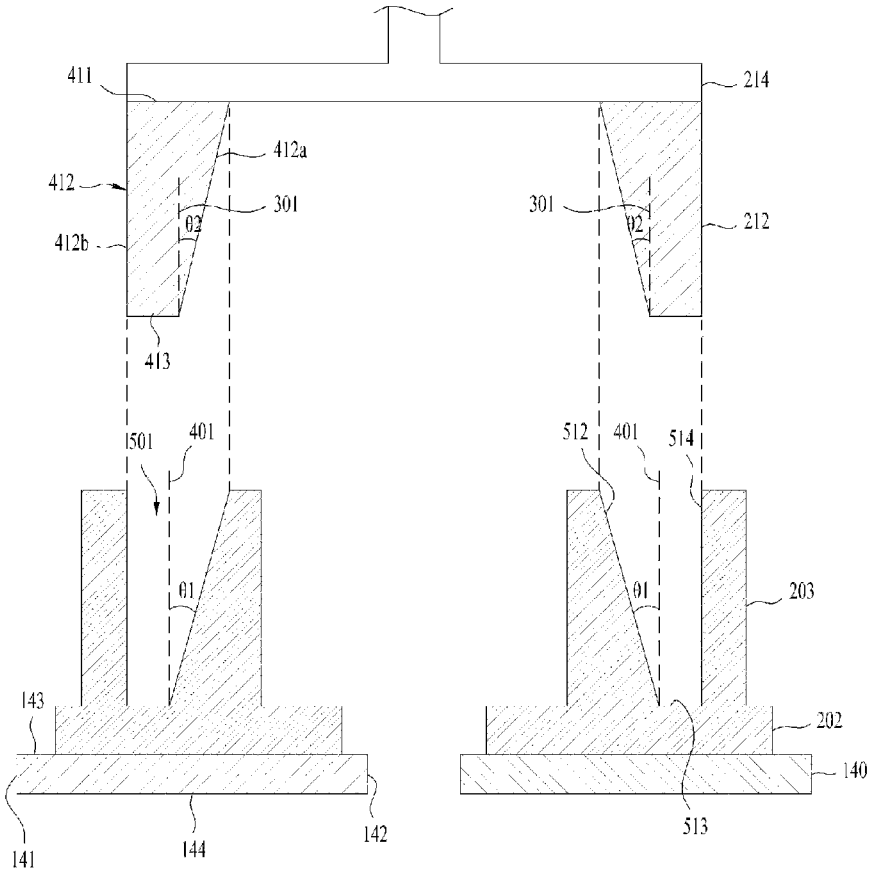
FIG. 2 is an exploded cross-sectional view of a shape adjustment unit shown in FIG. 1.

FIG. 1 is a cross-sectional view of a wafer polishing apparatus 100 in accordance with one embodiment and FIG. 2 is an exploded cross-sectional view of a shape adjustment unit 210 shown in FIG. 1.

With reference to FIGS. 1 and 2, the wafer polishing apparatus 100 may include a lower surface plate 110, a base 120, a base supporter 130, an upper surface plate 140, an upper surface plate rotator 150, a sun gear 160, an internal gear 170, at least one carrier (here, carriers 180-1 and 180-2), a controller 190, a first shape adjustment unit 210 and a second shape adjustment unit 220.

The lower surface plate 110 may be formed in a disc shape having a hollow and support wafers W1 and W2 loaded on the carriers 180-1 and 180-2. Polishing pads (not shown) to polish the wafers W1 and W2 may be mounted on the upper surface of the lower surface plate 110.

The base 120 is disposed under the lower surface plate 110, supports the lower surface plate 110 and rotates the lower surface plate 110. The base supporter 130 may be disposed under the base 120 and support the base 120 and the internal gear 170, which will be described later.

The lower surface plate 110 may be located on the base 120 so that the center of the lower surface plate 110 may be aligned with the center of the base 120 and the outer circumferential surface of the lower surface plate 110 may protrude from the outer circumferential surface of the base 120 in a second direction. For example, the diameter of the lower surface plate 110 may be greater than the diameter of the base 120. For example, the second direction may be a direction from the center of the lower surface plate 110 to the outer circumferential surface of the lower surface plate 110.

The base 120 may include a first rotary shaft 122 to rotate the lower surface plate 110, and the first rotary shaft 122 may be connected to the rear surface of the base 120 and rotate the base 120.

For example, the first rotary shaft 122 may be rotated in a designated direction (for example, the clockwise direction) by rotation of a driving motor (not shown), and the lower surface plate 110 may be rotated by rotational force of the first rotary shaft 122.

The upper surface plate 140 may be located on the lower surface plate 110 so that the lower surface of the upper surface plate 140 may be opposite the upper surface of the lower surface plate 110, and be formed in a disc shape having a hollow. Polishing pads (not shown) to polish the wafers W1 and W2 may be mounted on the lower surface of the lower surface plate 110.

The upper surface plate rotator 150 may rotate the upper surface plate 140 and move the upper surface plate 140 up and down. The upper surface plate rotator 150 may be connected to a plate 202 and include a second rotary shaft 152 to rotate the upper surface plate 140.

The second rotary shaft 152 may move the upper surface plate 140 up and down and, thus, adjust the load of the upper surface plate 140 applied to the wafers W1 and S2W2 of the carriers 180-1 and 180-2. For example, the second rotary shaft 152 may be connected to a pneumatic or hydraulic cylinder and the load of the upper surface plate 140 applied to the wafers W1 and W2 of the carriers 180-1 and 180-2 may be controlled by the pneumatic or hydraulic cylinder.

The sun gear 160 may include a plurality of first pins 162 and a supporter 161 to support the first pins 162.

The supporter 161 may be located within the hollow 111 of the lower surface plate 110 and have a disc shape, but the shape of the supporter 161 is not limited thereto. For example, the supporter 161 may have a ring shape but is not limited thereto.

The first pins 162 are arranged in a line on the upper surface of the supporter 161 so as to be separated from one another. The sun gear 160 shown in FIG. 1 may include a pin gear including the first pins 162, and the supporter 161.

The internal gear 170 may be located at the edge of the lower surface plate 110. For example, the internal gear 170 may have a disc shape, the inner circumferential surface of which surrounds the outer circumferential surface of the edge of the lower surface plate 110.

The internal gear 170 may include a plurality of second pins 172 and a second supporter 171 to support the second pins 172.

The second supporter 171 may be located on the base supporter 120 provided at the edge of the lower surface plate 110 and have a disc shape. For example, the second supporter 120 may have a ring shape but is not limited thereto.

The second pins 172 may be arranged in a line on the upper surface of the second supporter 171 so as to be separated from one another. The internal gear 170 shown in FIG. 1 may include a pin gear including the second pins 172, and the supporter 171.

The carriers 180-1 and 180-2 may be disposed between the upper surface of the lower surface plate 110 and the lower surface of the upper surface plate 140 and receive or load the wafers W1 and W2 to be polished.

Each of the at least one carriers 180-1 and 180-2 may include a carrier body having a wafer receipt hole to receive the wafer W1 or W2 and at least one slurry hole separated from the wafer receipt hole to pass a slurry, and a gear provided on the outer circumferential surface of the carrier body.

The carriers 180-1 and 180-2 may be formed of epoxy glass, urethane or a polymer. The carrier body may have a disc shape but is not limited thereto.

The gear formed on the outer circumference of the edge of each of the carriers 180-1 and 180-2 may be engaged with the first pins 162 of the sun gear 160 and the second pins 172 of the internal gear 170. The carriers 180-1 and 180-2 may be engaged with the sun gear 160 and the internal gear 170 and be rotated during the polishing process.

The first shape adjustment unit 210 adjusts the shape of the lower surface 144 of the upper surface plate 140. For example, the first shape adjustment unit 210 may apply pressure to the upper surface plate 140 and thus adjust the lower surface 144 of the upper surface plate 140 to have one of a concave shape in a first direction, a flat shape and a convex shape in the first direction. For example, the first direction may be a direction from the lower surface plate 110 to the upper surface plate 140.

The first shape adjustment unit 210 may adjust the lower surface 144 of the upper surface plate 140 to have one of a concave shape, a flat shape and a convex shape based on pressure applied to the upper surface plate 140 and restoring force of the upper surface plate 140.

The first shape adjustment unit 210 may include an upper surface plate supporter 202, 203, a first wedge member 212 and a first moving part 214.

The upper surface plate supporter 202, 203 may support the upper surface of the upper surface plate 140 and have a groove 501, the width of which increases in the first direction.

The upper surface plate supporter 202, 203 may include a plate 202 and a support part 203. The plate 202 may be attached closely to the upper surface 143 of the upper surface plate 140 so as to support the upper surface plate 140. The plate 202 may have a disc shape having a hollow but is not limited thereto. The upper surface 143 of the upper surface plate 140 may be attached to the lower surface of the plate 202 by an adhesive member or a fixing member.

The support part 203 may be connected to the upper surface of the plate 202, support the plate 202 and have the groove 501, into which the first wedge member 212 is inserted.

The support part 203 may have a cylindrical shape having the same hollow as the plate 202 but is not limited thereto.

One end of the support part 203 may be connected to the upper surface of the plate 202 and the other end of the support part 203 may be provided with the groove 501 into which the first wedge member 212 is inserted. For example, the groove 501 may have a through hole structure to expose the upper surface of the plate 202 but is not limited thereto. That is, in accordance with another embodiment, the groove 501 may not expose the upper surface of the plate 202.

Although the plate 202 and the support part 203 may be formed of different materials and thus combined, in accordance with another embodiment, the plate 202 and the support part 203 may be integrally formed.

The groove 501 of the support part 203 may be configured such that the width of the groove 501 may increase in the first direction, and have a shape coinciding with the first wedge member 212 so that the first wedge member 212 may be inserted into the groove 501.

For example, the groove 501 may include a first side surface 512, a second side surface 514, and a bottom 513 located between the first side surface 512 and the second side surface 514.

The first side surface 512 of the groove 501 may be located closer to an inner circumferential surface 142 of the upper surface plate 140 than an outer circumferential surface 141 of the upper surface plate 140, and the second side surface 514 of the groove 501 may be located closer to the outer circumferential surface 141 of the upper surface plate 140 than the inner circumferential surface 142 of the upper surface plate 140.

For example, the second side surface 514 of the groove 501 may be closer to the outer circumferential surface 141 of the upper surface plate 140 than the first side surface 512 of the groove 501.

The bottom 513 of the groove 501 may be parallel with the lower surface 144 of the upper surface plate 140. If the groove 501 has a through hole structure, the bottom 513 of the groove 501 may become the upper surface of the plate 202.

An angle θ1 formed by the first side surface 512 of the groove 501 and a first reference surface 401 may differ from an angle formed by the second side surface 514 of the groove 501 to the first reference surface 401.

For example, the angle θ1 formed by the first side surface 512 of the groove 501 and the first reference surface 401 may be greater than 0° and less than 90°. For example, the first reference surface 401 may be a surface vertical to the lower surface 144 of the upper surface plate 140.

The second side surface 514 of the groove 501 and the first reference surface 401 may be parallel with each other. The angle formed by the second side surface 514 and the first reference surface 401 may be 0° or 180°. That is, the second side surface 14 of the groove 501 may be vertical to the lower surface 144 of the upper surface plate 140.

Figure 3:
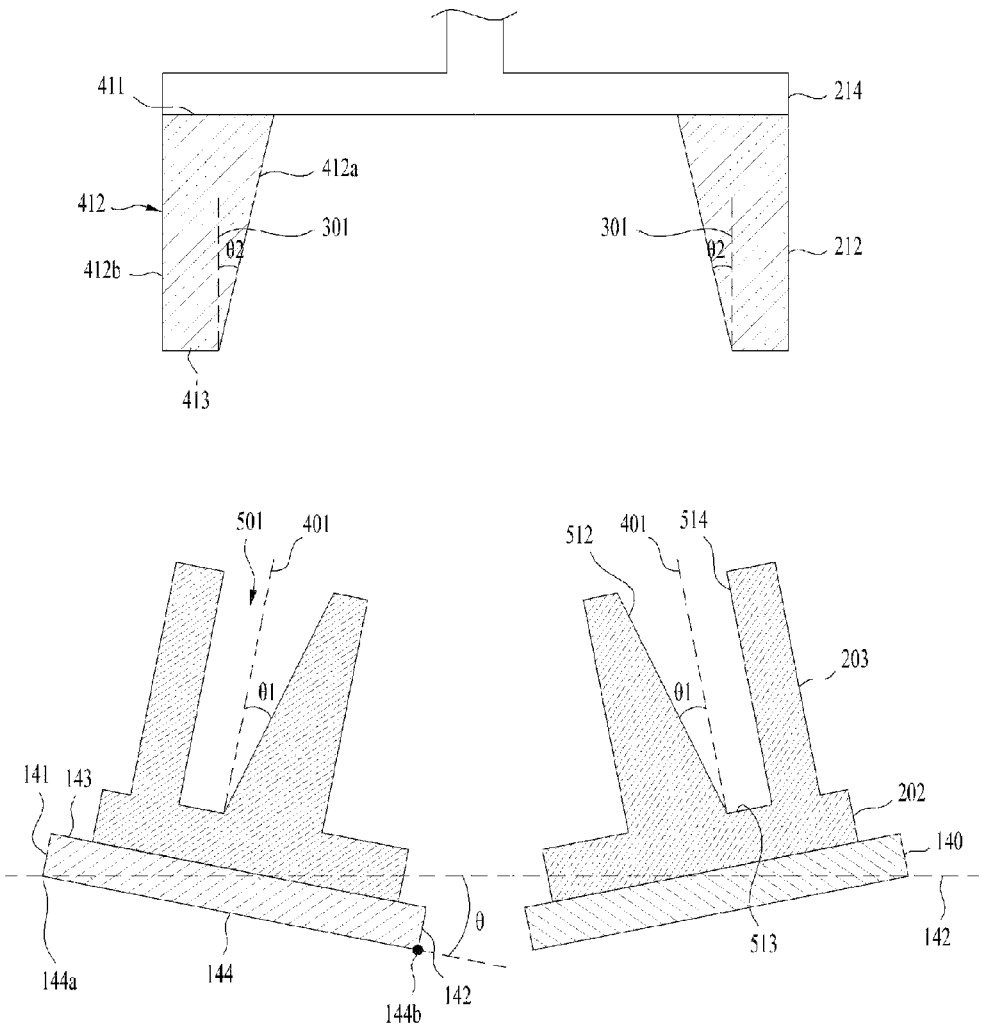
FIG. 3 is a view illustrating one exemplary upper surface plate and first shape adjustment unit shown in FIG. 1.

FIG. 3 is a view illustrating one exemplary upper surface plate 140 and first shape adjustment unit 210 shown in FIG. 1.

With reference to FIG. 3, the central part of the upper surface plate 140 may be concave in the first direction. The lower surface 144 of the upper surface plate 140 may be inclined downwards by a designated angle θ from a second reference surface 402 (with reference to FIG. 6). For example, the first direction may be a direction from the lower surface plate 110 to the upper surface plate 140.

For example, on the assumption that the direction from the lower surface plate 110 to the upper surface plate 140 is the first direction, the second reference surface 402 may be a virtual plane vertical to the first direction. Otherwise, when the front or rear surfaces of the wafers W1 and W2 are polished to be flat in the horizontal direction, the second reference surface 402 may be a virtual plane parallel with the horizontal direction.

When one end 144*a* of the lower surface 144 of the upper surface plate 140 is aligned with the second reference surface 402, the other end 144*b* of the lower surface 144 of the upper surface plate 140 may be separated from the second reference surface 402.

For example, one end 144*a* of the lower surface 144 of the upper surface plate 140 may be a region where the outer circumferential surface 141 and the lower surface 144 of the upper surface plate 140 meet and the other end 144*b* of the lower surface 144 of the upper surface plate 140 may be a region where the inner circumferential surface 142 and the lower surface 144 of the upper surface plate 140 meet.

The lower surface of the plate 202 and the lower surface 144 of the upper surface plate 140 may be parallel with each other. The lower surface of the plate 202 may be inclined by a designated angle from the second reference surface 402. For example, the inclination angle of the lower surface of the plate 202 from the second reference surface 402 may be the same as the inclination angle of the lower surface 144 of the upper surface plate 140.

The first wedge member 212 may be inserted into the groove 501 and have a shape coinciding with the shape of the groove 501. For example, the first wedge member 212 may have a shape, the width of which increases in the first direction.

The upper end 411 of the first wedge member 212 is connected to the first moving part 214, the lower end 413 of the first wedge member 212 is inserted into the groove 501, and the inserted first wedge member 212 is fixed in the groove 501.

The first wedge member 212 may include the upper end 411 connected to the first moving part 214, the lower end 413 inserted into the groove 501, and a side part 412 located between the upper end 411 and the lower end 413.

The thickness or width of the side part 412 of the first wedge member 212 may increase in the first direction.

Figure 4:
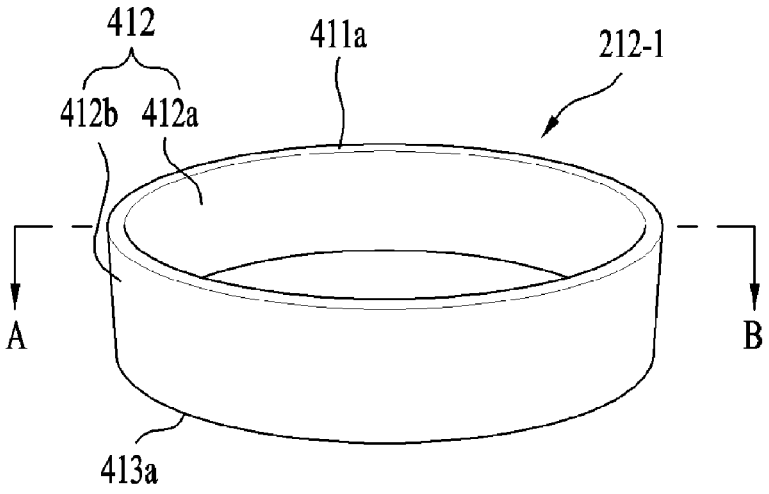
FIG. 4 is a view illustrating one exemplary wedge member shown in FIG. 1.

FIG. 4 illustrates one exemplary first wedge member 212-1 shown in FIG. 1. The cross-section of the first wedge member 212-1, taken along the line A-B, may be the same as that of the first wedge member 212 shown in FIG. 2.

With reference to FIG. 4, the first wedge member 212-1 may have a cylindrical structure. For example, the first wedge ember 212-1 may include an upper end 411*a* connected to the first moving part 214, a cylindrical side part 412, and a lower end 413*a*.

Here, the groove 501 may have a cylindrical shape corresponding to the first wedge member 212-1.

The side part 412 of the first wedge member 212-1 may include an inner circumferential surface, i.e., a first side surface 412*a*, and an outer circumferential surface, i.e., a second side surface 412*b*.

The first side surface 412*a* of the first wedge member 212-1 may have a shape corresponding to or coinciding with the shape of the first side surface 512 of the groove 501, and the second side surface 412*b* of the first wedge member 212-1 may have a shape corresponding to or coinciding with the shape of the second side surface 514 of the groove 501.

For example, an angle θ2 formed by the first side surface 412*a* of the first wedge member 212-1 and a third reference surface 301 may differ from an angle formed by the second side surface 412*b* of the first wedge member 212-1 and the third reference surface 301.

For example, the angle θ2 formed by the first side surface 412*a* of the first wedge member 212-1 and the third reference surface 301 may be greater than 0° and less than 90°. For example, the third reference surface 301 may be a surface vertical to the second reference surface 402.

The second side surface 412*b* of the first wedge member 212-1 and the third reference surface 301 may be parallel with each other and the angle between the second side surface 412*b* of the first wedge member 212-1 and the third reference surface 301 may be 0° or 180°.

For example, the angle θ2 formed by the first side surface 412*a* of the first wedge member 212-1 and the third reference surface 301 may be the same as the angle θ1 formed by the first side surface 512 of the groove 501 and the first reference surface 401 (θ2=θ1). Further, the angle formed by the second side surface 412*b* of the first wedge member 212-1 and the third reference surface 301 may be the same as the angle formed by the second side surface 514 of the groove 501 and the first reference surface 401.

Figure 5:
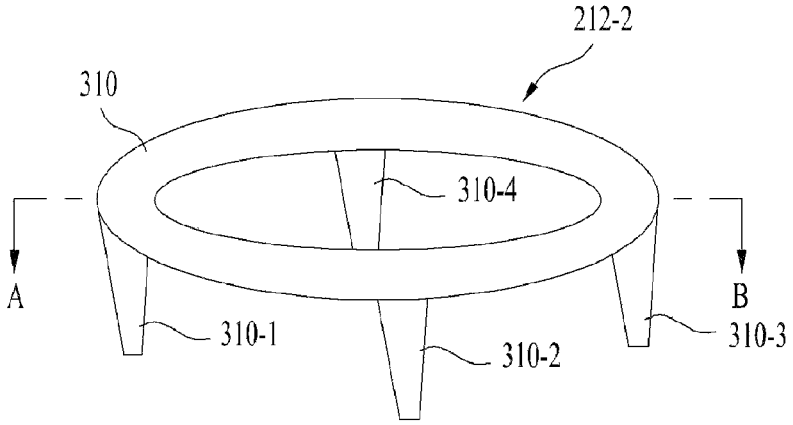
FIG. 5 is a view illustrating another exemplary wedge member shown in FIG. 1.

FIG. 5 illustrates another exemplary first wedge member 212-2 shown in FIG. 1. The cross-section of the first wedge member 212-2, taken along the line A-B, may be the same as that of the first wedge member 212 shown in FIG. 2.

With reference to FIG. 5, the first wedge member 212-2 may include a ring-shaped connector 310 and a plurality of legs 310-1 to 310-4 connected to the lower part of the connector 310.

The connector 310 is connected to the first moving part 214 and may serve to connect the legs 310-1 to 310-4 to the first moving part 214. Although FIG. 5 illustrates the connector 310 as having a ring shape, the connector 310 is not limited thereto and may have a disc shape or a polygonal plate shape.

Each of the legs 310-1 to 310-4 may include an upper end connected to the first moving part 214, a lower end inserted into the groove 501, and a side part located between the upper end and the lower end. The thickness or width of the side part of each of the legs 310-1 to 310-4 may increase in the first direction.

Each of the legs 310-1 to 310-4 may have a wedge shape.

Each of the legs 310-1 to 310-4 may include the first side surface 412*a* and the second side surface 412*b*, described above with reference to FIG. 4, and a detailed description thereof will thus be omitted.

A plurality of grooves (not shown) separated from one another and corresponding to the legs 310-1 to 310-4 may be provided on the other end of the support part 203. Each of the grooves may coincide with the shape of the corresponding one of the legs 310-1 to 310-4.

The first moving part 214 may be connected to the first wedge member 212 and move the first wedge member 212 in the first direction or the direction opposite to the first direction within the groove 501.

For example, the first moving part 214 may adjust the insertion depth of the wedge member 212 inserted into the groove 501. Here, the insertion depth of the wedge member 212 may be a distance between the lower end 413 of the first wedge member 212 inserted into the groove 501 and the bottom 513 of the groove 501.

For example, the first moving part 214 may include at least one of a pneumatic cylinder and a hydraulic cylinder (not shown) or include a motor.

The first moving part 214 may move the first wedge member 212 in the first direction or the direction opposite to the first direction within the groove 501 by pressure supplied by a pneumatic cylinder and/or a hydraulic cylinder or a motor.

Figure 6:
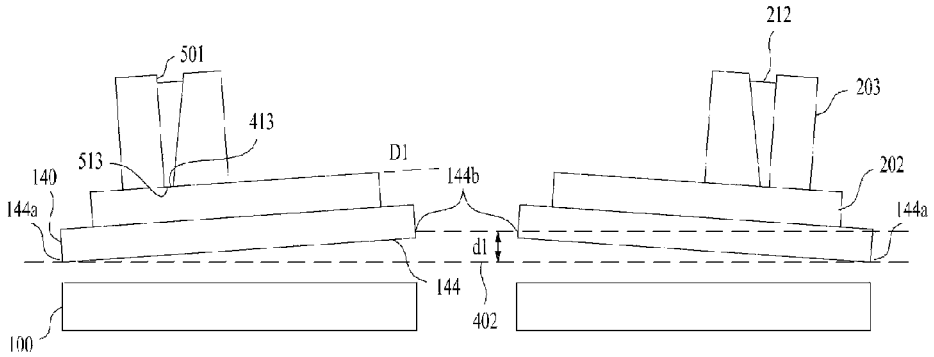
FIGS. 6 to 8 are views illustrating shapes of the upper surface plate according to insertion depths of a first wedge member.
Figure 7:
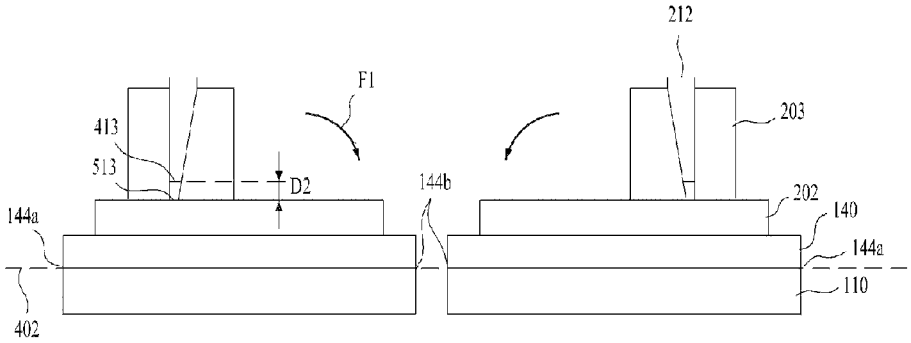
Figure 8:
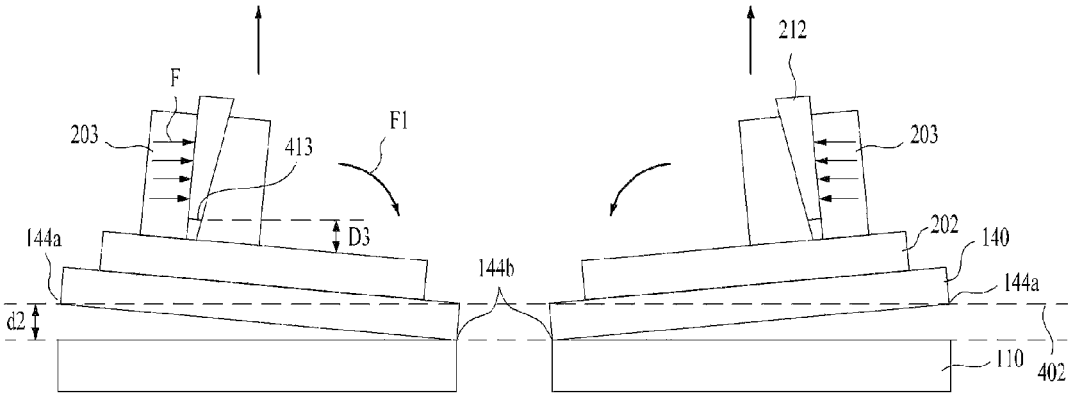

FIGS. 6 to 8 are views illustrating shapes of the upper surface plate 140 according to insertion depths of the first wedge member 212.

With reference to FIG. 6, the first moving part 214 may insert the first wedge member 212 into the groove 501 and then lower the first wedge member 212 until an insertion distance between the lower end 413 of the first wedge member 212 inserted into the groove 501 and the bottom 513 of the groove 501 reaches a first depth D1.

For example, the first moving part 214 may lower the first wedge member 212 so that the lower end 413 of the first wedge member 212 contacts the bottom 513 of the groove 501. Here, the first depth D1 may be zero but is not limited thereto.

When the first wedge member 212 is completely inserted into the groove 501, the concave shape of the upper surface plate 140 in the first direction shown in FIG. 3 may be changed to the convex shape in the first direction according to the insertion depth of the first wedge member 212 within the groove 501.

The reason for this is that pressure supplied by the first moving part 212 according to insertion of the first wedge member 212 into the groove 501 may be provided to the upper surface plate 140 through the first wedge member 212 and the pressure supplied to the upper surface plate 140 by the inclined structure of the first wedge member 212 and the groove 501 may act as force F to raise the other end 144*b* of the upper surface plate 140. For example, as the insertion depth increases, the force F to raise the other end 144*b* of the upper surface plate 140 may increase.

Further, when one end 144*a* of the lower surface 144 of the upper surface plate 140 is aligned with the second reference surface 402, the other end 144*b* of the lower surface 144 of the upper surface plate 140 may be located above the first reference surface 402.

For example, when the insertion depth of the first wedge part 212 is zero and one end 144*a* of the lower surface 144 of the upper surface plate 140 is aligned with the second reference surface 402, a separation distance d1 from the second reference surface 402 to the other end 144*b* of the lower surface 144 of the upper surface plate 140 may be 1 μm~500 μm.

With reference to FIG. 7, the first moving part 214 may raise the first wedge member 212 within the groove 501 so as to separate the lower end 413 of the first wedge member 212 from the bottom 513 of the groove 501.

As the first wedge member 212 is raised within the groove 501, the force F to raise the other end 144*b* of the upper surface plate 140 supplied through the first wedge member 212 may decrease. Further, as the force F to raise the other end 144*b* of the upper surface plate 140 decreases, the other end 144*b* of the upper surface plate 140 may be lowered by restoring force of the upper surface plate 140 to the original shape thereof.

As the first wedge member 212 is raised within the groove 501, the other end 144*b* of the upper surface plate 140 may be lowered so that the lower surface 144 of the upper surface plate 140 is parallel with the second reference surface 402.

The insertion depth of the upper surface plate 140 when the lower surface 144 of the upper surface late 140 is parallel with the second reference surface 402 is referred to as a second depth D2 (D2>D1).

With reference to FIG. 8, the first moving part 214 may raise the first wedge member 212 within the groove 501 so that the insertion depth of the first wedge member 212 exceeds the second depth D2.

As the insertion depth of the first wedge member 212 exceeds the second depth D2, the restoring force of the upper surface plate 140 is greater than the force to raise the other end 144*b* of the upper surface plate 140 and, thus, the central part of the upper surface plate 140 may be changed to have a concave shape in the first direction.

Further, when one end 144*a* of the lower surface 144 of the upper surface plate 140 is aligned with the second reference surface 402, the other end 144*b* of the lower surface 144 of the upper surface plate 140 may be located below the second reference surface 402.

For example, when the insertion depth of the first wedge member 212 is a third depth (D3>D2) and one end 144*a* of the lower surface 144 of the upper surface plate 140 is aligned with the second reference surface 402, a separation distance d2 from the second reference surface 402 to the other end 144*b* of the lower surface 144 of the upper surface plate 140 may be 1 μm~500 μm.

Figure 9:
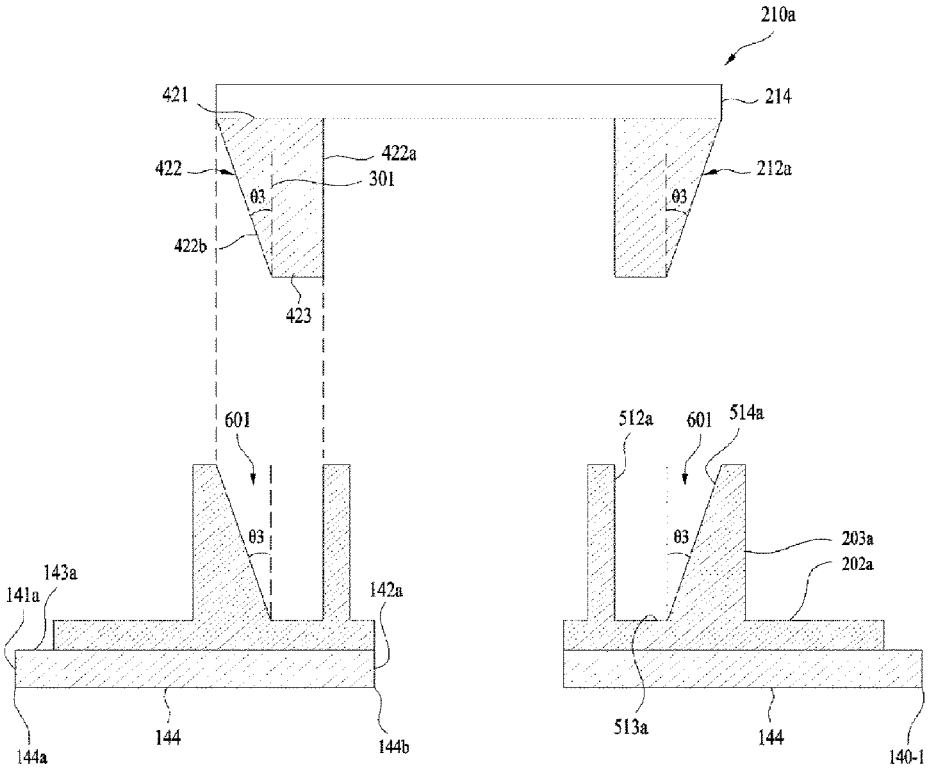
FIG. 9 is a cross-sectional view illustrating a shape adjustment unit and an upper surface plate in accordance with another embodiment.

FIG. 9 is a cross-sectional view illustrating a shape adjustment unit 210*a* and an upper surface plate 140-1 in accordance with another embodiment.

As compared to FIG. 2, the upper surface plate 140-1 may be formed in a shape, the central part of which is concave in the first direction.

With reference to FIG. 9, the first shape adjustment unit 210*a* may include a plate 202*a*, a support part 203*a*, a first wedge member 212*a*, and a first moving part 214. The elements shown in FIG. 9 which are substantially the same as those of FIG. 2 are denoted by the same reference numerals and a detailed description thereof will thus be omitted.

The support part 203*a* may be connected to the upper surface of the plate 202*a*, support the plate 202, and include a groove 601 into which the first wedge member 212*a* is inserted.

As compared to the support part 203 shown in FIG. 2, the groove 601 of the support part 203*a* may have a different shape as that of the groove 501 of the support part 203 shown in FIG. 2.

For example, the groove 601 of the support part 203*a* may include a first side surface 512*a*, a second side surface 514*b*, and a bottom 513*a* located between the first side surface 512.

For example, the first side surface 512*a* of the groove 601 of the support part 203*a* and the first reference surface 401 may be parallel with each other, and an angle θ3 formed by the second side surface 514*a* of the groove 601 of the support part 203*a* and the first reference surface 401 may be greater than 0° and less than 90°. The first side surface 512*a* of the groove 601 of the support part 203*a* may be vertical to the lower surface 144 of the upper surface plate 140.

Figure 10:
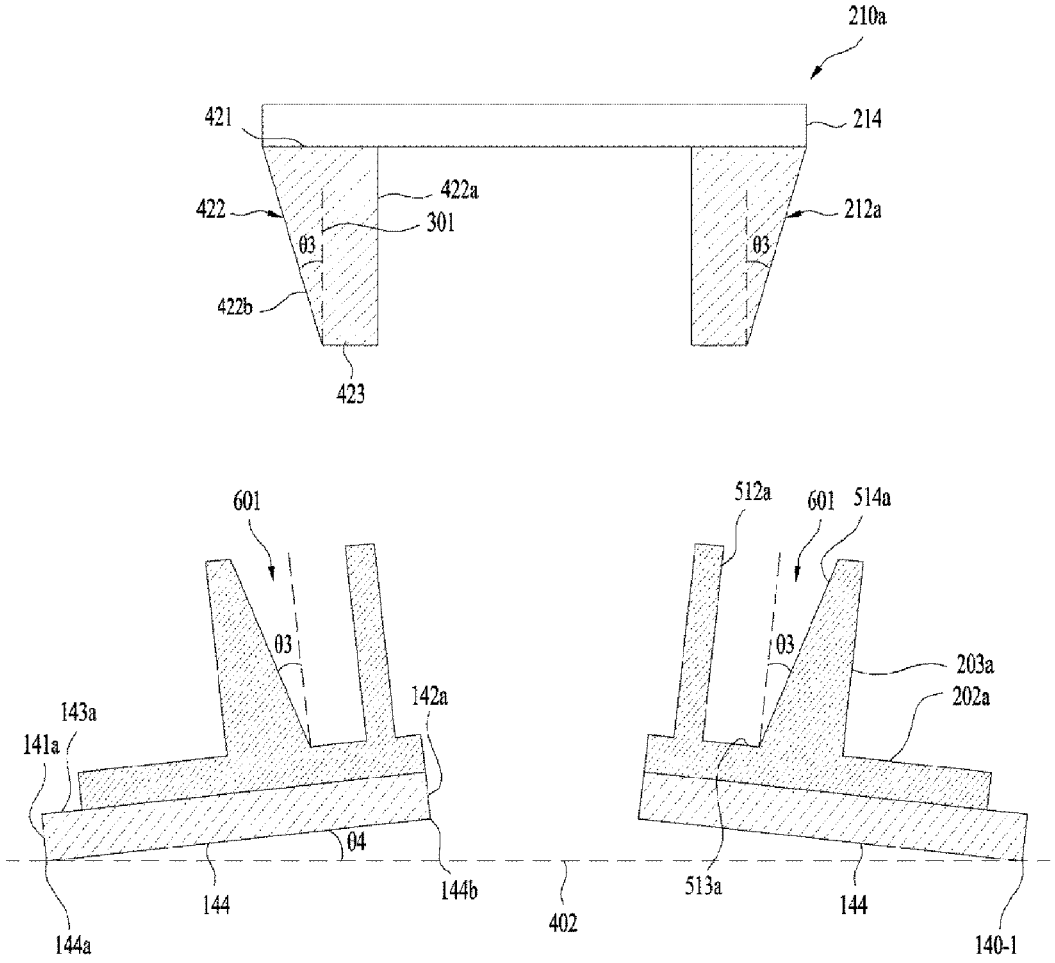
FIG. 10 is a view illustrating one exemplary upper surface plate and first shape adjustment unit shown in FIG. 0.

FIG. 10 is a view illustrating one exemplary upper surface plate 140-1 and first shape adjustment unit 210-*a* shown in FIG. 9.

With reference to FIG. 10, the central part of the upper surface plate 140-1 may be convex in the first direction. The lower surface 144 of the upper surface plate 140-1 may be inclined upwards by a designated angle θ4 from the second reference surface 402.

For example, when one end 144*a* of the lower surface 144 of the upper surface plate 140-1 is aligned with the second reference surface 402, the other end 144*b* of the lower surface 144 of the upper surface plate 140-1 and the second reference surface 402 may be separated from each other.

The lower surface of the plate 202*a* and the lower surface 144 of the upper surface plate 140-1 may be parallel with each other. The lower surface of the plate 202*a* may be inclined by a designated angle θ4 from the second reference surface 402.

The first wedge member 212*a* may be inserted into the groove 601 and have a shape coinciding with the shape of the groove 601.

The upper end 421 of the first wedge member 212*a* is connected to the first moving part 214, the lower end 423 of the first wedge member 212*a* is inserted into the groove 601, and the inserted first wedge member 212*a* is fixed in the groove 601.

For example, the first wedge member 212*a* may include the upper end 421 connected to the first moving part 214, the lower end 423 inserted into the groove 601, and a side part 422 located between the upper end 421 and the lower end 423. The thickness of the side part 421 of the first wedge member 212*a* may decrease in a direction from the upper end 421 to the lower end 423.

The first wedge member 212*a* may have a cylindrical structure or a structure including a ring-shaped connector and a plurality of legs connected to the connector.

For example, the side part 422 of the first wedge member 212*a* may include an inner circumferential surface, i.e., a first side surface 422*a*, and an outer circumferential surface, i.e., a second side surface 422*b*.

The first side surface 422*a* of the first wedge member 212*a* may have a shape corresponding to or coinciding with the shape of the first side surface 512*a* of the groove 601, and the second side surface 422*b* of the first wedge member 212*a* may have a shape corresponding to or coinciding with the shape of the second side surface 514*a* of the groove 601.

For example, the first side surface 422*a* of the first wedge member 212*a* and the third reference surface 302 may be parallel with each other and the angle between the first side surface 422*a* of the first wedge member 212*a* and the third reference surface 302 may be 0° or 180°.

The angle θ3 formed by the second side surface 422*b* of the first wedge member 212*a* and the third reference surface 301 may be greater than 0° and less than 90°.

Figure 11:
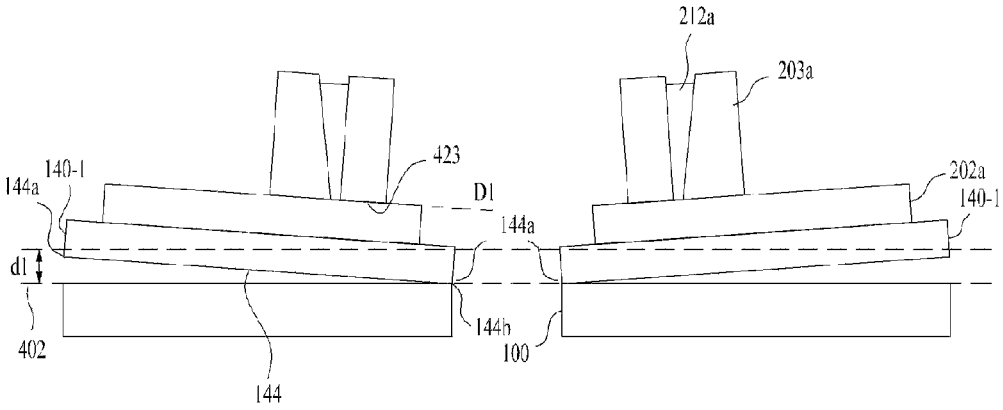
FIGS. 11 to 13 are views illustrating shapes of the upper surface plate according to insertion depths of a first wedge member.
Figure 12:
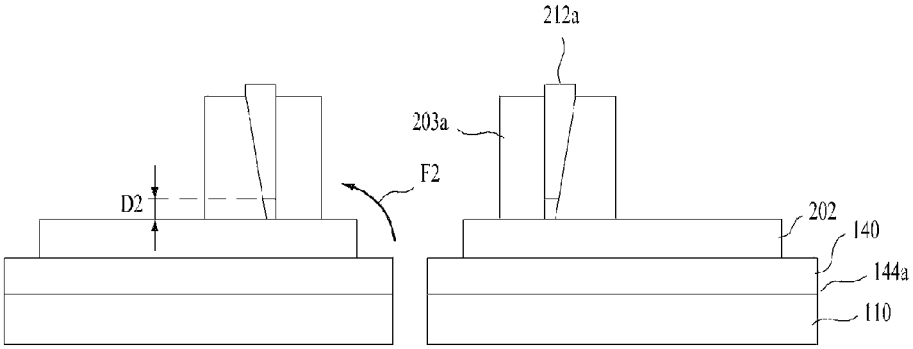
Figure 13:
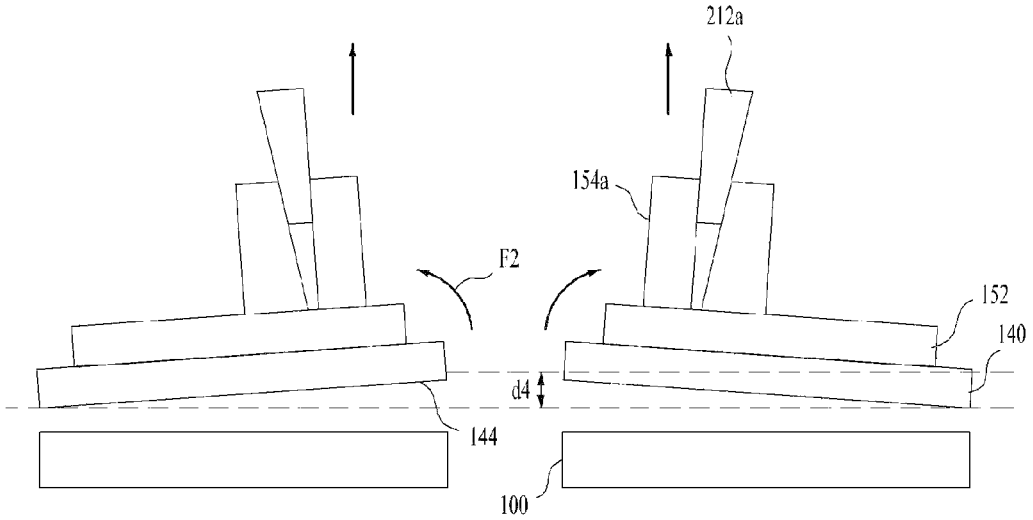

FIGS. 11 to 13 are views illustrating shapes of the upper surface plate 140-1 according to insertion depths of the first wedge member 212*a*.

With reference to FIG. 11, the first moving part 214 may insert the first wedge member 212*a* into the groove 601 and then lower the first wedge member 212*a* until an insertion distance between the lower end 423 of the first wedge member 212*a* inserted into the groove 601 and the bottom 513*a* of the groove 601 reaches a first depth D1.

For example, the first moving part 214 may lower the first wedge member 212*a* so that the lower end 423 of the first wedge member 212*a* contacts the bottom 513*a* of the groove 601. Here, the first depth D1 may be zero but is not limited thereto.

When the first wedge member 212*a* is completely inserted into the groove 601, the convex shape of the upper surface plate 140-1 in the first direction shown in the first direction may be changed to the concave shape in the first direction according to the insertion depth of the first wedge member 212*a* within the groove 601.

When one end 144*a* of the lower surface 144 of the upper surface plate 140-1 is aligned with the second reference surface 402, the other end 144*b* of the lower surface 144 of the upper surface plate 140-1 may be located above the first reference surface 402.

For example, when the insertion depth of the first wedge part 212*a* is zero and one end 144*a* of the lower surface 144 of the upper surface plate 140-1 is aligned with the second reference surface 402, a separation distance d3 from the second reference surface 402 to the other end 144*b* of the lower surface 144 of the upper surface plate 140-1 may be 1 μm~500 μm.

With reference to FIG. 12, the first wedge member 212*a* may be raised within the groove 601, the other end of the first wedge member 212*a* may be raised so that the insertion depth of the first wedge member 212*a* reaches a second depth D2, and the lower surface 144 of the upper surface plate 140-1 may be parallel with the second reference surface 402.

With reference to FIG. 13, as the insertion depth of the first wedge member 2121 exceeds the second depth D2, the central part of the upper surface plate 140-1 may be changed to have a convex shape in the first direction.

Further, when one end 144*a* of the lower surface 144 of the upper surface plate 140-1 is aligned with the second reference surface 402, the other end 144*b* of the lower surface 144 of the upper surface plate 140-1 may be located above the second reference surface 402.

For example, when the insertion depth of the first wedge member 212 is a third depth (D3>D2) and one end 144*a* of the lower surface 144 of the upper surface plate 140-1 is aligned with the second reference surface 402, a separation distance d4 from the second reference surface 402 to the other end 144*b* of the lower surface 144 of the upper surface plate 140-1 may be 1 μm~500 μm.

The controller 190 controls the first moving part 214, thus controlling the insertion position of the first wedge member 212 or 212*a* within the groove 501 or 601.

For example, if the first moving part 214 includes at least one of a pneumatic cylinder and a hydraulic cylinder, the controller 190 may include a valve to adjust pressure applied to the pneumatic or hydraulic cylinder, for example, a solenoid valve.

For example, the controller 190 may generate control signals to adjust the solenoid value so that the insertion depth of the first wedge member 212 or 212*a* becomes one of first to third depths.

For example, if the first moving part 214 includes a motor, the controller 190 may include an inverter to output an electrical signal to drive the motor.

The second shape adjustment unit 220 adjusts the shape of the upper surface of the lower surface plate 110.

The second shape adjustment unit 220 may adjust the shape of the upper surface of the lower surface plate 110 to be one of a concave shape, a flat shape and a convex shape by applying pressure to the lower surface plate 110.

The second shape adjustment unit 220 may include at least one second wedge member 222 disposed between the base 120 and the lower surface plate 110 and at least one second moving part 214 to move the at least one second wedge member 222 in the second direction or the direction opposite to the second direction.

As the at least one second wedge member 222 moves in the second direction or the direction opposite to the second direction, the upper surface of the lower surface plate 110 may have one of a concave shape, a flat shape and a convex shape.

Figure 14:
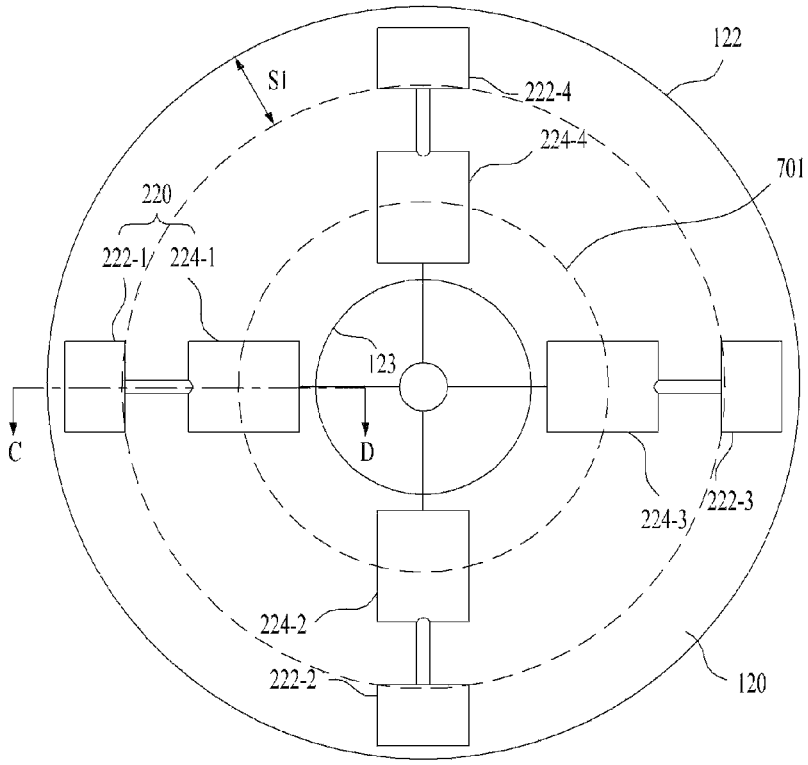
FIG. 14 is a plan view illustrating a second shape adjustment unit and a base shown in FIG. 1.
Figure 15:
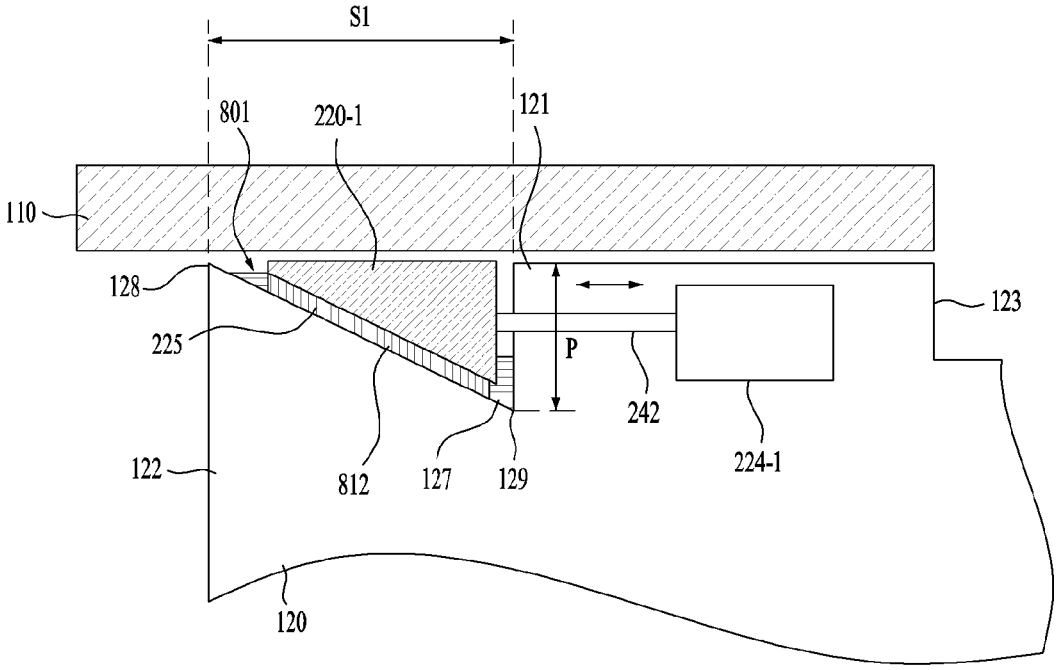
FIG. 15 is a cross-sectional view of the second shape adjustment unit and the base shown in FIG. 14, taken along the line C-D.

FIG. 14 is a plan view illustrating the second shape adjustment unit 220 and the base 120 shown in FIG. 1 and FIG. 15 is a cross-sectional view of the second shape adjustment unit 220 and the base 120 shown in FIG. 14, taken along the line C-D.

With reference to FIGS. 14 and 15, the second shape adjustment unit 220 may include at least one second wedge member, at least one second moving part, and at least one connection part connecting the at least one second wedge member and the at least one second moving part.

For example, the second shape adjustment unit 220 may include a plurality of second wedge members 222-1 to 222-4, a plurality of second moving parts 214-1 to 214-4, and connection parts 242 connecting the second wedge members 222-1 to 222-4 and the second moving parts 214-1 to 214-4.

The second wedge members 222-1 to 222-4 may have the same configuration and the second moving parts 214-1 to 214-4 may have the same configuration.

Each of the second wedge members 222-1 to 222-4 may have a wedge structure, the thickness or width of which decreases in the second direction and vice versa but is not limited thereto.

The second wedge members 222-1 to 222-4 may be disposed in a first region S1 of the upper surface 121 of the base 120. In order to uniformly change the shape of the lower surface plate 110, the second wedge members 222-1 to 222-4 may be disposed symmetrically with respect to the central part of the base 120 or the central part of the lower surface plate 110 as the origin.

For example, the first region S1 may be a partial region of the upper surface 121 of the base 120 which is located between the outer circumferential surface of the base 120 and a central line 701 of the base 120. A separation distance of the central line 701 of the base 120 from the outer circumferential surface 122 of the base 120 and a separation distance of the central line 701 of the base 120 from the inner circumferential surface 123 of the base 120 may be equal.

For example, the second wedge members 222-1 to 222-4 may be disposed closer to the outer circumferential surface 122 of the base 120 than the inner circumferential surface 123 of the base 120.

The dispositions of the second wedge members 222-1 to 222-4 are not limited to FIGS. 14 and 15 and, in accordance with another embodiment, the second wedge members 222-1 to 222-4 may be disposed closer to the inner circumferential surface 123 of the base 120 than the outer circumferential surface 122 of the base 120 or disposed across the left and right sides of the central line 701. Here, the dispositions of the second wedge members 222-1 to 222-4 may include positions of the second wedge members 222-1 to 222-4 moved by the second moving parts 214-1 to 214-4.

The base 120 may include grooves 801 into which the second wedge members 222-1 to 222-4 are respectively inserted or fitted. The grooves 801 prepared in number corresponding to the number of the second wedge members 222-1 to 222-4 may be provided on the upper surface 121 of the base 120.

The shape of the grooves 801 may correspond to or coincide with the shape of the second wedge members 222-1 to 222-4 so that the second wedge members 222-1 to 222-4 may be inserted or fitted into the grooves 801.

Bottoms 812 of the grooves 801 may be inclined from the second reference surface 402.

For example, the bottoms 812 of the groove 801 may be inclined upwards in the second direction.

The grooves 801 may be provided within the first region S1 of the upper surface 121 of the base 120.

The second shape adjustment unit 220 may further include bearings 225 disposed between the second wedge members 222-1 to 222-4 and the grooves 801 of the base 120 so as to reduce friction between the second wedge members 222-1 to 222-4 and the grooves 801 of the base 120.

The bearings 225 may be provided on the bottoms 812 of the grooves 801 or provided on the outer circumferential surfaces of the second wedge members 222-1 to 222-4.

The bearings 225 allow the second wedge members 222-1 to 222-4 to smoothly move within the grooves 801.

One end 128 of the groove 801 may contact the outer circumferential surface 122 of the base 120 but is not limited thereto. In another embodiment, one end 128 of the groove 801 may not directly contact the outer circumferential surface 122 of the base 120 and be separated from the outer circumferential surface 122 of the base 120.

In order to facilitate motion of bearings 225, a lubricant 127, such as oil or grease, may be supplied to the bearings 225. The other end 129 of the groove 801 may have a height difference P with the upper surface 121 of the base 120. Since the other end 129 of the groove 801 has a height difference P with the upper surface 121 of the base 120, the lubricant 127 may be sufficiently supplied to the bearings 225 at all times when the second wedge members 222-1 to 222-4 are moved.

Each of the second moving parts 224-1 to 224-4 may move the corresponding one of the second wedge members 222-1 to 222-4 in a direction from the inner circumferential surface 123 of the base 120 to the outer circumferential surface 122 of the base 120 or in the opposite direction.

Each of the second moving parts 224-1 to 224-4 may include at least one of a pneumatic cylinder and a hydraulic cylinder (not shown) or include a motor.

Figure 16:
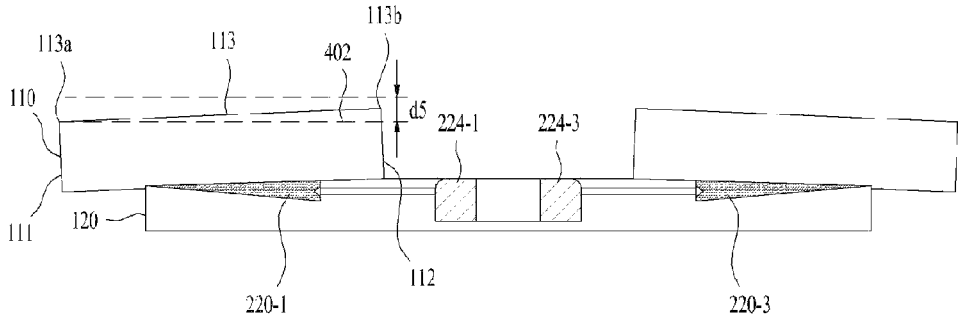
FIGS. 16 to 18 are views illustrating change of the shape of a lower surface plate according to movement of second wedge members.
Figure 17:
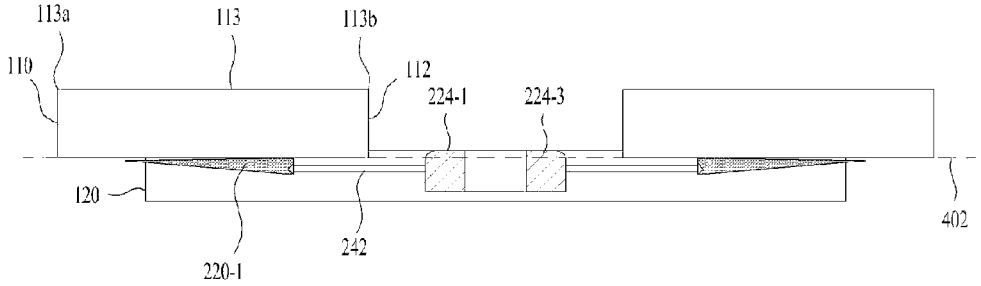
Figure 18:
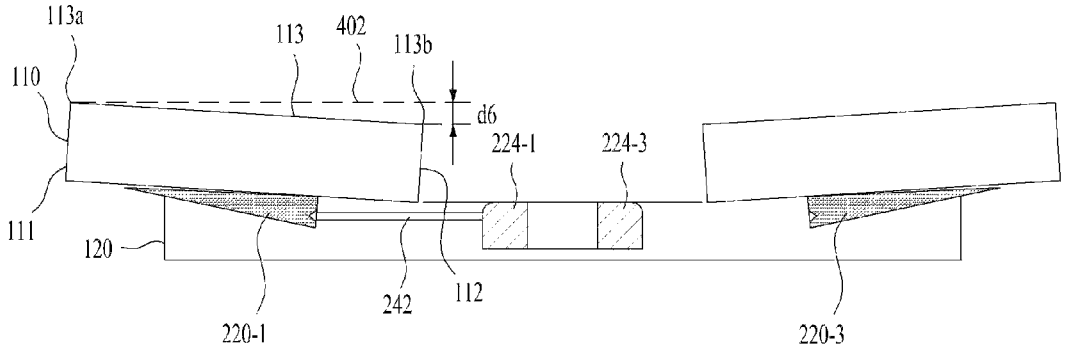

FIGS. 16 to 18 are views illustrating change of the shape of the lower surface plate according to movement of the second wedge members 222-1 to 222-4.

With reference to FIG. 16, when the second wedge members 222-1 to 222-4 are located at a first position, the central part of the upper surface 113 of the lower surface plate 110 may be convex in the first position.

The first position may mean a case that force is not applied to the lower surface plate 110 by the second wedge members 222-1 to 222-4. In this case, the central part of the upper surface 113 of the lower surface plate 110 may be convex in the first position.

For example, the first position may be a position at which the second wedge members 222-1 to 222-4 are located within the grooves 801 and do not protrude outwards from the grooves 801. At the first position, the second wedge members 222-1 to 222-4 may be separated from the ends 129 of the grooves 801 by a first distance or contact the ends 129 of the grooves 801.

At the first position, when one end 113*a* of the upper surface 113 of the lower surface plate 110 is aligned with the second reference surface 402, the other end 113*b* of the upper surface 113 of the lower surface plate 110 may be located above the second reference surface 402. At the first position, when the end 113*a* of the upper surface 113 of the lower surface plate 110 is aligned with the second reference surface 402, a separation distance d5 from the second reference surface 402 to the other end 113*b* of the upper surface 113 of the lower surface plate 110 may be 1 μm~500 μm.

With reference to FIG. 17, when the second wedge members 222-1 to 222-4 are located at a second position, the upper surface 113 of the lower surface plate 110 may be parallel with the second reference surface 402. As compared to the first position, the second position may be a position at which the second wedge members 222-1 to 222-4 are disposed closer to the outer circumferential surface of the lower surface plate 110.

The second wedge members 222-1 to 222-4 may move in a direction from the inner circumferential surface 123 to the outer circumferential surface 122 of the base 120 by the second moving parts 214-1 to 214-4.

The end 113*a* of the upper surface 113 of the lower surface plate 110 may be relatively raised and the other end 113*b* of the upper surface 113 of the lower surface plate 110 may be relatively lowered by the moved second wedge members 222-1 to 222-4, as compared to FIG. 16.

Accordingly, as the second wedge members 222-1 to 222-4 move to the second position, the upper surface 113 of the lower surface plate 110 having the central part, which is convex in the first direction, may be changed to be parallel with the second reference surface 402.

With reference to FIG. 18, when the second wedge members 222-1 to 222-4 are located at a third position, the upper surface 113 of the lower surface plate 110 may be changed to have a shape, the central part of which is concave in the first direction.

As compared to the second position, the third position may be a position at which the second wedge members 222-1 to 222-4 are disposed closer to the outer circumferential surface of the lower surface plate 110.

Here, the second wedge members 222-1 to 222-4 may further move in the direction from the inner circumferential surface 123 to the outer circumferential surface 122 of the base 120 by the second moving parts 214-1 to 214-4, as compared to the second position.

The end 113*a* of the upper surface 113 of the lower surface plate 110 may be relatively raised and the other end 113*b* of the upper surface 113 of the lower surface plate 110 may be relatively lowered by the further moved second wedge members 222-1 to 222-4, as compared to FIG. 17.

Consequently, as the second wedge members 222-1 to 222-4 move to the third position, the upper surface 113 of the lower surface plate 110 which is parallel with the second reference surface 402 may be changed to have a shape, the central part of which is concave in the first direction.

At the third position, when the end 113*a* of the upper surface 113 of the lower surface plate 110 is aligned with the second reference surface 402, the other end 113*b* of the upper surface 113 of the lower surface plate 110 may be located below the second reference surface 402. At the third position, when the end 113*a* of the upper surface 113 of the lower surface plate 110 is aligned with the second reference surface 402, a separation distance d6 from the second reference surface 402 to the other end 113*b* of the upper surface 113 of the lower surface plate 110 may be 1 μm~500 μm.

Figure 19:
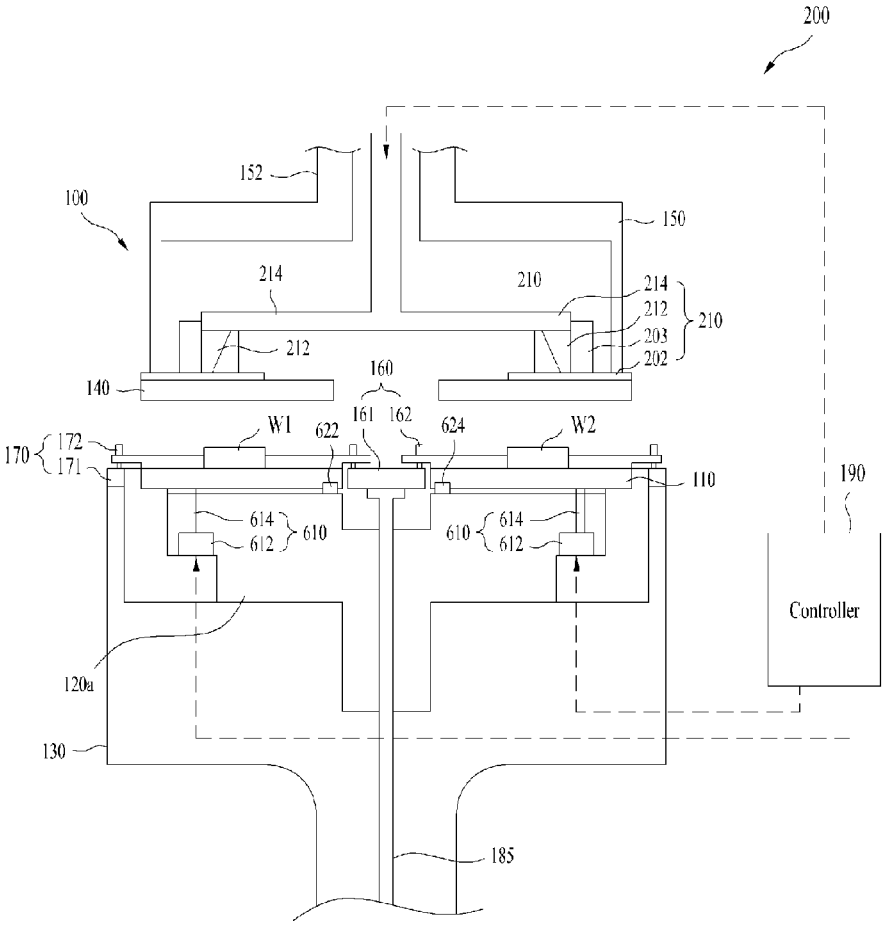
FIG. 19 is a cross-sectional view of a wafer polishing apparatus in accordance with another embodiment.

FIG. 19 is a cross-sectional view of a wafer polishing apparatus 200 in accordance with another embodiment. Elements of the wafer polishing apparatus 200 which are substantially the same as those of FIG. 1 are denoted by the same reference numerals and a detailed description thereof will thus be omitted.

With reference to FIG. 19, the wafer polishing apparatus 200 may include a lower surface plate 110, a base 120*a*, a base supporter 130, an upper surface plate 140, an upper surface plate rotator 150, a sun gear 160, an internal gear 170, at least one carrier (here, carriers 180-1 and 180-2), a controller 190, a first shape adjustment unit 210 and a second shape adjustment unit 610.

The second shape adjustment unit 610 may adjust the shape of the upper surface of the lower surface plate 110 to be one of a concave shape, a flat shape and a convex shape in the first direction by applying pressure to one region of the lower surface plate 110.

The base 120*a* and the second shape adjustment unit 610 in the embodiment shown in FIG. 19 may be different from those in the embodiment shown in FIG. 1.

Figure 20:
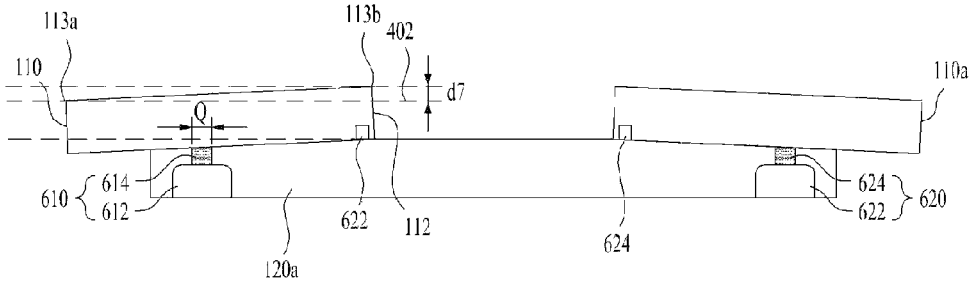
FIGS. 20 to 22 are views illustrating change of the shape of a lower surface plate according to motion of a second shape adjustment unit.
Figure 21:
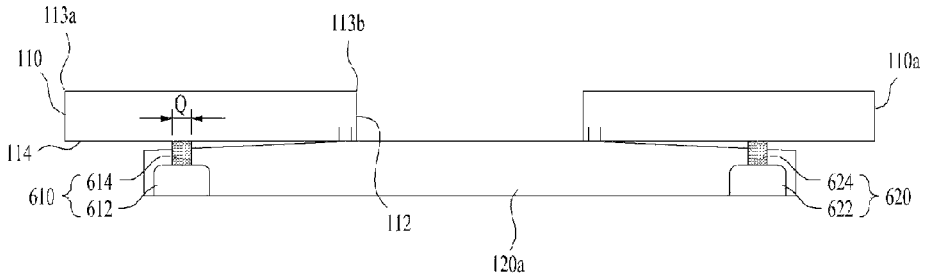
Figure 22:
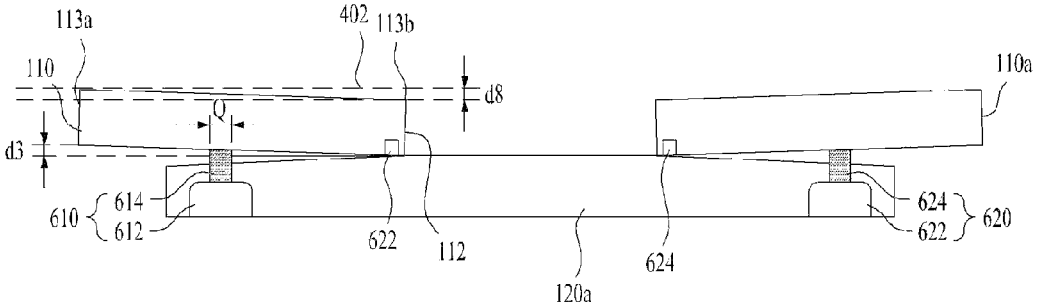
Figure 23A:
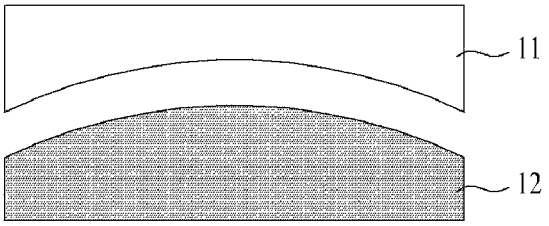
FIGS. 23A to 23C are views illustrating upper surface plates and lower surface plates having various shapes.
Figure 23B:
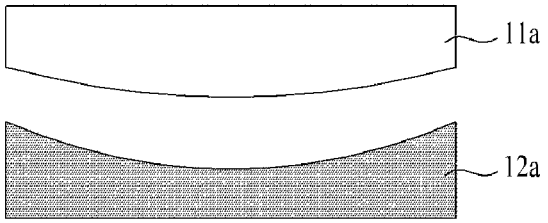
Figure 23C:
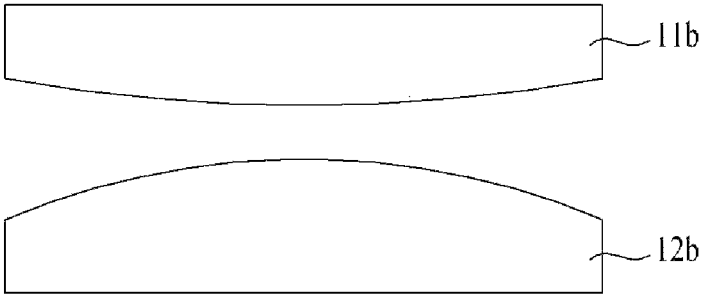

FIGS. 20 to 22 are views illustrating change of the shape of the lower surface plate 110 according to motion of the second shape adjustment unit 610.

With reference to FIG. 20, the upper surface of the base 120*a* may include an inclined surface having a high central part and a low edge part.

For example, the upper surface of the base 120*a* may be an inclined surface, the height of which is gradually lowered in a direction from the central part of the base 120*a* to the outer circumferential surface of the base 120*a*.

The second shape adjustment unit 610 may change the heights of one end 113*a* and the other end 113*b* of the upper surface 113 of the lower surface plate 110 by applying pressure to one region of the lower surface 114 of the lower surface plate 110.

The second shape adjustment unit 610 may include a support part 612 connected to a first region Q of the lower surface 114 of the lower surface plate 110 and supporting the first region Q of the lower surface 114 of the lower surface plate 110, and an elevating part 624 to raise or lower the support part 612.

The first region Q of the lower surface 114 of the lower surface plate 110 may be one region of the lower surface 114 of the lower surface plate 110 located between the outer circumferential surface of the lower surface plate 110 and a central line 901 of the lower surface plate 110.

For example, the first region Q of the lower surface 114 of the lower surface plate 110 may be closer to the outer circumferential surface 111 of the lower surface plate 110 than the inner circumferential surface 112 of the lower surface plate 110.

With reference to FIG. 20, when pressure is not applied to the lower surface plate 110 by the second shape adjustment unit 610, the upper surface of the base 120*a* is inclined and, thus, the upper surface 113 of the lower surface plate 110 located on the base 120*a* may be convex in the first direction.

That is, when one end 113*a* of the upper surface 113 of the lower surface plate 110 is aligned with the second reference surface 402, the other end 113*b* of the upper surface 113 of the lower surface plate 110 may be located above the second reference surface 402. Here, a separation distance d7 from the second reference surface 402 to the other end 113*b* of the upper surface 113 of the lower surface plate 110 may be 1 μm~500 μm.

With reference to FIG. 21, when the elevating part 624 raises the support part 612, the shape of the upper surface 113 of the lower surface plate 110 may be changed to be parallel with the second reference surface 402. The reason for this is that the end 113*a* of the upper surface 113 of the lower surface plate 110 may be raised and the other end 113*b* of the upper surface 113 of the lower surface plate 110 may be lowered by raising the support part 612 so that the upper surface 113 of the lower surface plate 110 is parallel with the second reference surface 402.

With reference to FIG. 22, when the elevating part 624 further raises the support part 612, the upper surface 113 of the lower surface plate 110 may be changed to have a concave shape in the first direction.

That is, when the end 113*a* of the upper surface 113 of the lower surface plate 110 is aligned with the second reference surface 402, the other end 113*b* of the upper surface 113 of the lower surface plate 110 may be located below the second reference surface 402. Here, a separation distance d7 from the second reference surface 402 to the other end 113*b* of the upper surface 113 of the lower surface plate 110 may be 1 μm~500 μm.

The elevating part 624 may include at least one of a pneumatic cylinder and a hydraulic cylinder (not shown) or include a motor. For example, the elevating part 624 may include an up-down motor.

As described above, since the shapes of the upper surface plate 140 and the lower surface plate 110 may be automatically changed by the first shape adjustment unit 210 and the second shape adjustment unit 220, the wafer polishing apparatus may automatically adjust the shapes of the upper surface plate 140 and the lower surface plate 110 which are most suitable for wafer processing conditions and improve flatness of a wafer.

Further, the wafer polishing apparatus does not require detachment of the upper surface plate 140 and the lower surface plate 110 when the shapes of the upper surface plate 140 and the lower surface plate 110 are changed, thus shortening a polishing time and preventing increase in costs.

As apparent from the above description, a wafer polishing apparatus in accordance within one embodiment of the present invention may automatically adjust the shapes of an upper surface plate and a lower surface plate most proper to wafer processing conditions, improve flatness of a wafer, shorten a polishing time, and prevent increase in cost.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A wafer polishing apparatus comprising:

a base;

a lower surface plate disposed on an upper surface of the base;

an upper surface plate located on the lower surface plate; and a shape adjustment unit configured to deform a shape of a lower surface of the upper surface plate so that the lower surface of the upper surface plate has one of a concave shape, a flat shape and a convex shape in a first direction, wherein the shape adjustment unit includes:

an upper surface plate supporter configured to support an upper surface of the upper surface plate, and the upper surface plate supporter including a groove having a width increasing in the first direction; and a wedge member inserted into the groove, wherein:

the shape of the lower surface of the upper surface plate is deformed according to an insertion depth of the wedge member; and the insertion depth of the wedge member is a distance between a lower end of the wedge member inserted into the groove and a bottom of the groove, and wherein the first direction is a direction from the lower surface plate to the upper surface plate.

2. The wafer polishing apparatus according to claim 1, wherein the upper surface plate supporter includes:

a first plate configured to support the upper surface of the upper surface plate; and a support part provided with one end connected to the first plate and including the groove.

3. The wafer polishing apparatus according to claim 2, wherein the groove includes a first side surface, a second side surface and a bottom located between the first side surface and the second side surface, wherein the second side surface is closer to an outer circumferential surface of the upper surface plate than the first side surface.

4. The wafer polishing apparatus according to claim 3, wherein a first angle formed by the first side surface and a first reference surface differs from a second angle formed by the second side surface and the first reference surface, and the first reference surface is vertical to the lower surface of the upper surface plate.

5. The wafer polishing apparatus according to claim 4, wherein the first angle is greater than 0° and less than 90°, and the second side surface is parallel to the first reference surface.

6. The wafer polishing apparatus according to claim 4, wherein the first side surface is parallel to the first reference surface, and the second angle is greater than 0° and less than 90°.

7. The wafer polishing apparatus according to claim 2, wherein the wedge member has a cylindrical shape and the groove has a cylindrical shape coinciding with the shape of the wedge member.

8. The wafer polishing apparatus according to claim 2, wherein:

a plurality of first grooves is provided so as to be separated from one another; and the wedge member includes:

a ring-shaped connector connected to the first moving part; and a plurality of legs connected to the ring-shaped connector, wherein each of the legs has a wedge shape and is inserted into a corresponding one of the first grooves.

9. The wafer polishing apparatus according to claim 1, wherein, prior to insertion of the wedge member into the groove, a central part of the lower surface of the upper surface plate has a concave shape in the first direction or a convex shape in the first direction.

10. The wafer polishing apparatus according to claim 1, wherein the shape adjustment unit includes a moving part configured to move the wedge member in the first direction or in a direction opposite to the first direction within the groove.

11. A wafer polishing apparatus comprising:

a base;

a lower surface plate disposed on an upper surface of the base;

an upper surface plate disposed on the lower surface plate; and a shape adjustment unit disposed between the base and the lower surface plate and configured to deform a shape of an upper surface of the lower surface plate so that the upper surface of the lower surface plate has one of a concave shape, a flat shape and a convex shape in a first direction, wherein the shape adjustment unit includes:

at least one wedge member disposed between the upper surface of the base and the lower surface plate; and at least one moving part configured to move the at least one wedge member in a second direction or in a direction opposite to the second direction, wherein the shape of the upper surface of the lower surface plate is deformed according to a moving position of the at least one wedge member, and wherein the first direction is a direction from the lower surface plate to the upper surface plate, and the second direction is a direction from a center of the lower surface plate to an outer circumferential surface of the lower surface plate.

12. The wafer polishing apparatus according to claim 11, wherein the at least one wedge member is disposed closer to an outer circumferential surface of the base than an inner circumferential surface of the base.

13. The wafer polishing apparatus according to claim 11, wherein a groove is provided on the upper surface of the base so that the at least one wedge member is inserted into the groove.

14. The wafer polishing apparatus according to claim 13, wherein the bottom of the groove is inclined upwards in the second direction and one end of the bottom of the groove has a height difference with the upper surface of the base.

15. The wafer polishing apparatus according to claim 13, further comprising a bearing disposed between the groove and the at least one wedge member.

16. The wafer polishing apparatus according to claim 11, wherein a plurality of wedge members are provided so as to be disposed symmetrically with respect to the center of the lower surface plate as origin symmetry.

17. The wafer polishing apparatus according to claim 11, wherein:

the upper surface of the base is inclined downwards in a second direction; and the shape adjustment unit is configured to change a height of a first end of the upper surface of the lower surface plate and a height of a second end of the upper surface of the lower surface plate.

18. The wafer polishing apparatus according to claim 17, wherein the shape adjustment unit includes:

a support part configured to support a first region of a lower surface of the lower surface plate; and an elevating part configured to raise or lower the support part, wherein the first region of the lower surface of the lower surface plate is closer to an outer circumferential surface of the lower surface plate than an inner circumferential surface of the lower surface plate.

* * * * *